United States Patent [19]

Beckmann

[11] 4,186,969

[45] Feb. 5, 1980

[54] APPARATUS FOR CONTROLLING THE POSITION OF A MINING MACHINE

[75] Inventor: Klaus Beckmann, Lünen, Fed. Rep. of Germany

[73] Assignee: Gewerkschaft Eisenhutte Westfalia, Lunen, Fed. Rep. of Germany

[21] Appl. No.: 816,582

[22] Filed: Jul. 18, 1977

[30] Foreign Application Priority Data

Jul. 23, 1976 [DE] Fed. Rep. of Germany ..... 2633286

[51] Int. Cl.[2] ..... E21C 35/08

[52] U.S. Cl. ..... 299/43; 308/3 R; 308/4 R; 405/291

[58] Field of Search ..... 308/3 R, 4 R; 299/43, 299/42, 31, 33, 106; 61/45 D

[56] References Cited

U.S. PATENT DOCUMENTS

| | | | |
|---|---|---|---|
| 2,486,787 | 11/1949 | Johnson | 308/4 |
| 3,418,814 | 12/1968 | Groetschel | 61/45 D |
| 3,445,143 | 5/1969 | Swenson | 308/3 R |
| 3,897,982 | 8/1975 | Teramachi | 308/6 R |
| 3,915,500 | 10/1975 | Schlusener et al. | 61/45 D |
| 4,010,618 | 3/1977 | Walker | 61/45 D |
| 4,082,360 | 4/1978 | Campbell | 299/43 |

FOREIGN PATENT DOCUMENTS 2234452 1/1974 Fed. Rep. of Germany .

*Primary Examiner*—William F. Pate, III

*Attorney, Agent, or Firm*—Thompson, Birch, Gauthier & Samuels

[57] ABSTRACT

Apparatus for controlling the position of a mineral mining machine, such as a plough, movable along a main guide at one side of a scraper-chain conveyor employs cantilevered beams extending between the conveyor and a series of roof supports. Each beam is preferably resiliently flexible and is connected, for example via a bracket at an opposite side of the conveyor, to the main guide. A device, such as a hydraulic piston and cylinder unit, is used to adjust the inclination between the beam and the guide in generally known manner. The end portion of the beam remote from the conveyor extends alongside a side mounting surface of the floor structure of an associated one of the supports which mounting surface faces the next adjacent support. A further guide means, which may take the form of a tube containing a ball or a similar guide member or a guideway along which a guide member is displaceable, is detachably secured to the mounting surface of the support. The guide member of the further guide means is connected to the end of the beam so as to support the latter while allowing some free pivotal displacement in all directions as well as displacement axially and parallel to the support.

16 Claims, 6 Drawing Figures

APPARATUS FOR CONTROLLING THE POSITION OF A MINING MACHINE

BACKGROUND TO THE INVENTION

The present invention relates to mineral mining installations and more particularly to apparatus for controlling the position of a mineral mining machine movable along a guide. One example of control apparatus of this kind is shown in German Patent Specification No. 2319910.

One form of known apparatus has hydraulic piston and cylinder units connected between the machine guide and elongate beams capable of pivoting in relation to the guide. The beams are connected to roof supports at their ends remote from the guide and serve as an abutment for the guide. It is known to utilize composite resilient bars or rods as the beams and each beam then has its bars connected via a connector and a bracket to the goaf side of a scraper-chain conveyor having the main machine guide at its mineral-face side. At the opposite ends the bars connect to a guide which locates in a slidable manner with a floor structure of one of the roof supports which is usually a self-advancing support with individually movable frames. In the case of self-advancing supports the floor rails of the frames would have guideways into which the guide connected to the bars slidably engage. The guide thus couples the floor rails together and this per se inhibits the floor rails from adapting themselves to any unevenness in the floor level. Moreover some adaptation of the supports or their floor structures to accept the guides is necessary and with known forms of apparatus there are limitations on the type of the supports and hitherto the apparatus has not been readily applicable to supports having a single floor-engaging part. Another disadvantage of known apparatus is that in general extensive adjustability is not possible.

A general object of this invention is to provide an improved form of apparatus.

SUMMARY OF THE INVENTION

In one aspect the invention provides apparatus for controlling the position of a mineral mining machine guided for movement on guide means; said apparatus comprising at least one beam connected with said guide means, at least one device operable to adjust the angle between the guide means and the beam and further guide means arranged at a mounting surface of a support which faces an adjacent support of a mine installation, the further guide means serving to pivotably and displaceably connect the end of the beam remote from the first-mentioned guide means to said support and to permit limited all-round angular mobility thereof.

The invention also provides apparatus for controlling the position of a mineral mining machine guided for movement on guide means; said apparatus comprising at least one beam connected with said guide means, at least one device operable to adjust the angle between the guide means and the beam and further guide means secured to a mounting surface of a support which faces an adjacent support of a mine installation, the further guide means serving to support and guide the end of the beam remote from the first mentioned guide means and to impart a limited all-round angular mobility thereto.

The term "beam" is used in a general sense and a single bar or a plurality of bars, preferably resilient may constitute the beam. The mounting surface would normally be the side surface of a floor structure of the support.

The first-mentioned guide means may be disposed at one side of a conveyor and the beam and adjusting device may then be connected with bracket means at the opposite side of the conveyor. The bracket means can be fixed or displaceable in relation to the conveyor.

The first-mentioned guide means may also be embodied by a scraper-chain conveyor with one or more plough guides. In a complete mine working it would normally be desirable to provide a plurality of beams and adjustment devices as well as a plurality of further guide means as aforementioned. A piston and cylinder unit may serve as the adjusting device and the unit may be mounted in an upright or in an inclined position between a head piece at the end of the beam nearest the machine guide and the conveyor or bracket means thereon.

The further guide means for the or each beam may comprise mutually co-operating relatively movable components secured to the mounting surface and the beam, respectively, the component secured to the mounting surface being detachable and adjustable in position.

In one embodiment the further guide means comprises a hollow, or tubular, member containing a guide such as a piston or a ball. The guide within the tubular member is then movable in all directions and is coupled with the end of the associated beam. The beam, here usually a single bar, extends more or less coaxially of the tubular member and is considerably smaller in cross-section than the tubular member. The tubular member itself is preferably closed at the end remote from the beam and is detachably secured to the mounting surface of the associated support. Fixing means can be provided for this purpose. Preferably the tubular member or the further guide means only extends over the rear end portion or the central portion of the floor structure of the support.

It is possible also to employ a piston and cylinder unit as the further guide means.

In another construction, described hereinafter, the further guide means takes the form of an elongate guideway detachably secured to the mounting surface and receiving a slidable guide connected to the beam.

In constructing apparatus in accordance with the invention it is desirable to provide sufficient adjustability to the various components of the control apparatus, in both vertical and horizontal senses to permit the conveyor, the main guide and the support to move more or less independently without affecting the operation of the apparatus itself. Interalia it is useful to provide limited adjustment for the further guide means in relation to the associated support.

In general, in a complete installation employing apparatus made in accordance with the invention a guided beam extends between adjacent supports and is coupled to the floor structure of one of the supports. Since the supports are independently displaceable to follow the working progress the guided beams may also serve to align and guide the supports and to maintain the desired spacing therebetween.

The present invention also provides a mineral mining installation comprising a scraper-chain conveyor with a machine guide at one side; roof supports arranged at the opposite side of the conveyor, beams extending between the conveyor and the roof supports, devices operable to vary the angle between the beams and the machine guide, and guide means for displaceably supporting the ends of the beams remote from the conveyor and allowing a limited all-round mobility thereof, the guide means being arranged at mounting surfaces of the floor structure of the roof supports which face the floor structure of adjacent roof supports.

The invention may be understood more readily and various other features of the invention may become more apparent from consideration of the following description.

BRIEF DESCRIPTION OF DRAWINGS

Embodiments of the invention will now be described, by way of examples only, with reference to the accompanying drawings wherein.

DESCRIPTION OF PREFERRED EMBODIMENTS

Figure 1:
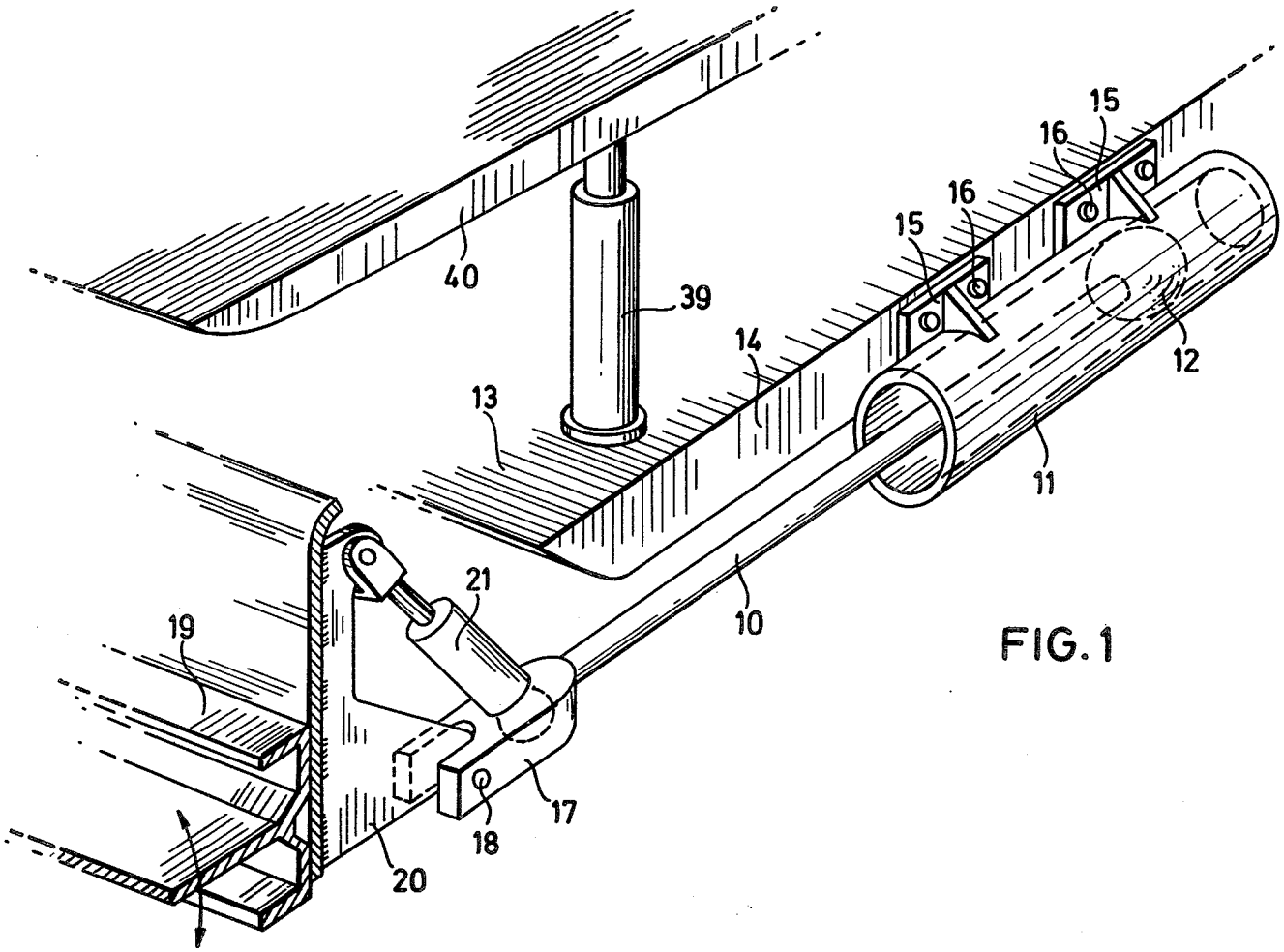
FIG. 1 is a part-sectional perspective representation of part of a mineral mining installation employing an arrangement representing a first embodiment of apparatus made in accordance with the invention.

Referring initially to FIG. 1, a mine installation has a scraper-chain conveyor 19 arranged alongside a mineral face in known manner and for convenience only the goaf side wall of the conveyor 19 is shown in FIG. 1. Although not shown in FIG. 1, it can be assumed that a winning machine and more usually a plough is disposed at the mineral face side of the conveyor 19 and this machine is guided for movement back and forth along the mineral face side of the conveyor 19. At the goaf side of the conveyor 19, i.e., the side remote from the mineral face, there are arranged roof supports which may be of any known type such as chocks or self-advancing units. The supports are spaced apart along the mine working. One such support is shown in FIG. 1 to comprise a floor structure 13, a roof bar 40 and one or more props 39 therebetween. In known manner the prop or props 39 can be extended or retracted to raise or lower the roof bar 40.

In accordance with the invention, apparatus is provided to control the position of the machine or plough. In general, the apparatus comprises a plurality of assemblies each as depicted in FIG. 1. Thus as shown, a cantilevered or jib-like beam or bar 10, which is preferably resiliently-yieldable, extends partly within a guide tube 11 and is supported for pivoting therein. The tube 12 is closed at its rear end and is open at the front end to receive the bar 10. The end of the bar 10 remote from the conveyor 19 is connected to a pivot guide, here in the form of a spherical ball 12, which is received in the tube 12. The ball 12 frictionally engages with its exterior periphery on the inner surface of the tube 11 and since the diameter of the bar 10 is somewhat smaller than the internal diameter of the tube 11 the bar 10 has a certain amount of free clearance of pivotal movement in relation to the tube 12. The exterior of the tube 11 is provided with fixing means, here in the form of webbed-plates 15, securable to an external side mounting surface 14 of the floor structure 13 of the associated support with the aid of screws 16. The mounting surface 14 faces the next adjacent support (not shown) and corresponding surfaces 14 of some or all the floor structures 13 of the supports would carry guide tubes 11 as described and illustrated. It is preferable to provide some adjustment for the tubes 11 in relation to the floor structures 13 in both the vertical and lateral directions. This can be accomplished by providing vertically-orientated slots in the plates 15 to accept the screws 16 and by providing shims or packings between the plates 15 and their associated mounting surfaces 14.

In the assembly or apparatus represented in FIG. 1, the rod 10 has a bi-furcated head piece 17 at its end nearest the conveyor 19. The head piece 17 is pivotably connected to a bracket 20 here affixed to the goaf side of the conveyor 19. In this construction the bracket 20 is secured to a barrier or spill plate attachment affixed to the conveyor goaf side wall. The pivotal connection between the head piece 17 and the bracket 20 is effected by means of a pivot pin 18 extending between the arms of the head piece and through an aperture in a foot portion of the bracket 20. The pin 18 extends in a direction generally parallel to the conveyor 19 and perpendicularly to the rod 10. A hydraulic piston and cylinder unit 21, which takes an inclined disposition, has its cylinder connected to or formed with, a spherical part 21 which locates within a corresponding socket in the head piece 17 to form a ball-and-socket connection. The piston rod of the unit 21 is articulated with a linkage to an upper region of the bracket 20.

During use of the mine installation the units 21 can be extended or retracted to vary the inclination between the conveyor 19 and the bars 10 as represented by the arrow in FIG. 1. This in turn serves to control the position of plough or machine guided on the conveyor. With the construction described and illustrated, particularly with the provision of the ball 12 and the tube 11 as an effective flexible abutment, the conveyor and the guide have good lateral stability. The provision of the ball 12 and the tube 11 as a guide permit universal pivotal movement of the bar 10 without altering the height of the support for the bar 10 with respect to the floor level. When the conveyor 19 is shifted up, e.g., by conventional shifting rams (not shown) to follow the working progress the conveyor moves in relation to the supports and towards the mineral face. Consequently, any dirt which penetrates the tube 11 will be pushed out of the tube 11 when the ball 12 moves along the tube 11 towards the face in the manner of a piston, when the conveyor is shifted.

Figure 2:
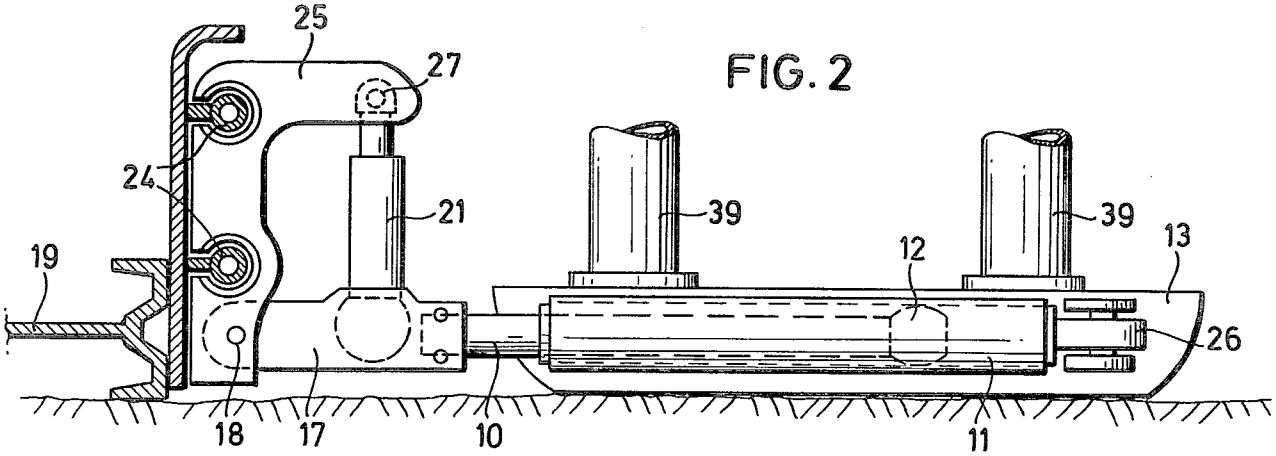
FIG. 2 is a part-sectional end view of part of a mineral mining installation employing an arrangement representing a second embodiment of apparatus made in accordance with the invention.
Figure 3:
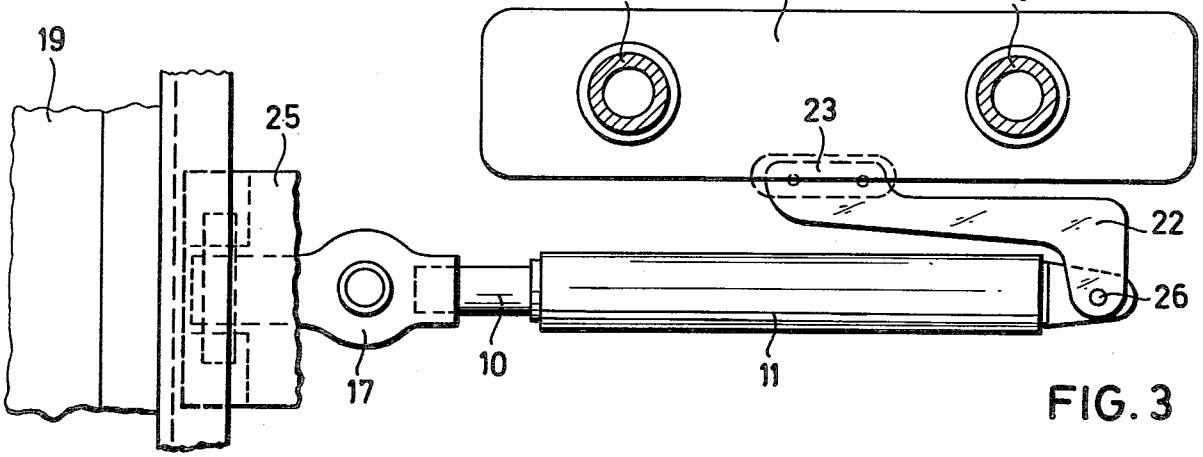
FIG. 3 is a part-sectional plan view of the part of the installation shown in FIG. 2.

Referring now to FIGS. 2 and 3, a further form of arrangement or apparatus made in accordance with the invention is shown together with the associated parts of the mine installation and for convenience like reference numerals are used to denote similar components to the construction of FIG. 1. In contrast to the FIG. 1 construction, the guide tube 11 has an extension at the end remote from the conveyor 19 which is pivotably connected, with the aid of an upstanding pivot pin 26, to a bracket 22. The bracket 22 is cranked or generally L-shaped in plan view (FIG. 3) to provide a major portion extending generally parallel to the floor structure 13 of the associated support and to the tube 11 and a minor portion connected to the tube 11. The major portion of the bracket 22 is connected to the floor structure 14 as at 23. Preferably the bracket 22 is resilient, at least in the vertical sense, relative to the installation. Instead of using a simple pin 26 to pivotably connect the bracket 22 to the tube 11 a universal joint or a vertical pin with a limited freedom of movement in a horizontal sense can be adopted. As shown in FIGS. 2 and 3 the goaf side wall of the conveyor 19 supports an attachment plate, such as a barrier or spill plate, at the outer side of which is provided two guide rails 24. A connection bracket 25 of L-shaped form is mounted with its upstanding portion for sliding along the rails 24 parallel to the conveyor 19. The end of the bar 10 is again connected to a head piece 17 which is pivotably connected to the lower end of the upstanding portion of the bracket 25 with the aid of a pin 18. An upstanding piston and cylinder unit 21 has its cylinder connected with the head piece 17 via a ball-and-socket joint and its piston rod pivotably connected to an outwardly projecting upper portion of the bracket 25 via a pin 27. As before a plurality of arrangements would normally be provided for the entire installation and in general the operation of the resultant control apparatus is similar to that of the first embodiment described above. Apparatus made in accordance with FIGS. 2 and 3 is useful for use with installations with inclined mineral seams.

Figure 4:
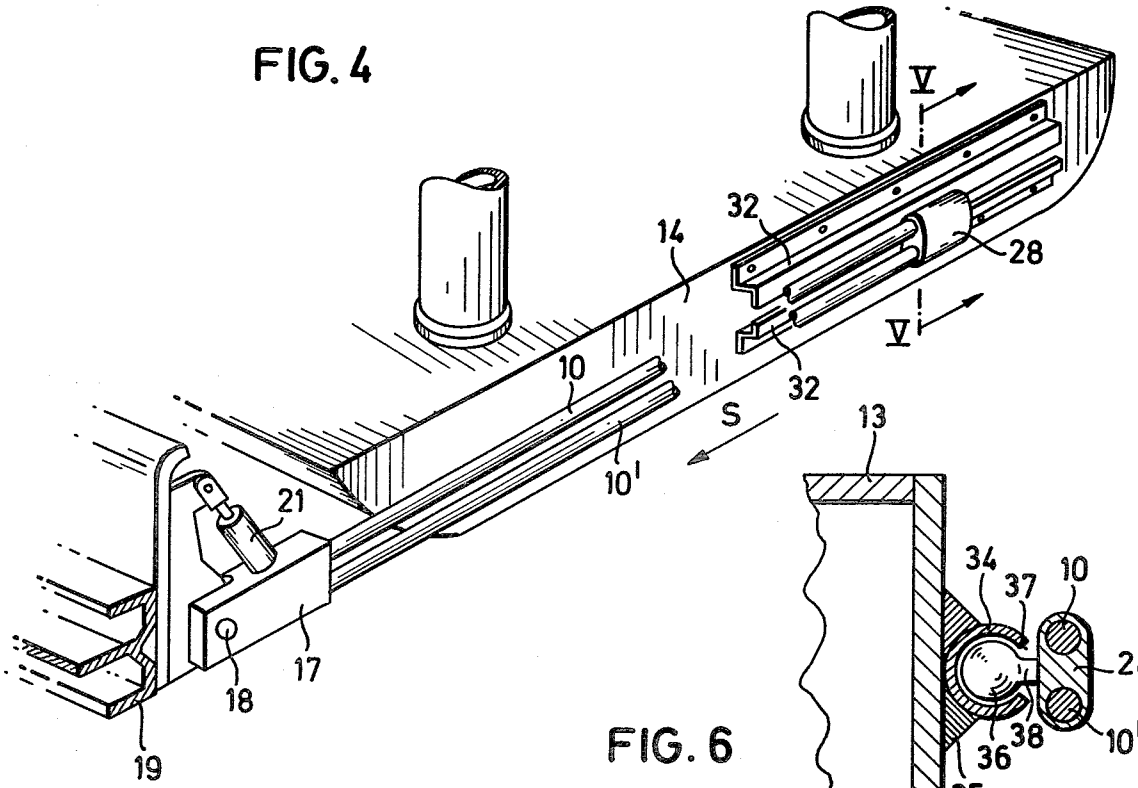
FIG. 4 is a part-sectional perspective representation of part of a mineral mining installation employing an arrangement representing a third form of apparatus made in accordance with the invention.
Figure 5:
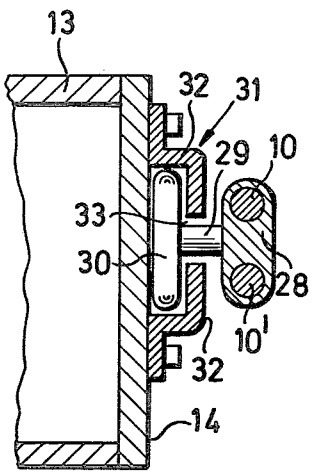
FIG. 5 is a sectional view taken along the line V—V of FIG. 4.

In the construction shown in FIGS. 4 and 5 two bars 10, 10' are disposed one above the other and are preferably again resilient. The ends of the bars 10,10' nearest the conveyor 19 are interconnected by a head piece 17 which supports the cylinder of an inclined piston and cylinder unit 21. As in the construction depicted in FIG. 1 the piston rod of the unit 21 and the head piece 17 are pivotably connected to a bracket which is fixed or so connected to the conveyor 19 as to effect the desired tilting action. At the outermost, i.e., goaf-side ends, the bars 10,10' are interconnected by a connector 28 which is displaceably mounted on guide means 31 including a guideway 32 fixed to a mounting surface 14 of the floor structure of the associated support. More particularly, as shown in FIG. 5, the connector 28 is connected by a cross piece 29 to a guide member 30 which locates within a space defined between the guideway 32 and the surface 14. The guideway 32 has a longitudinal slot 33 through which the cross piece 29 extends and can conveniently take the form of two parallel shaped rails secured via flanges and screws to the surface 14. The guide means 31 composed of the components 30, 29, 32 serves to guide the connector 28 and hence the bars 10, 10' for movement in the shifting direction S as shown in FIG. 4. By providing some clearance between the guide members 30 and the guideway 32 and between the slot 33 and the crosspiece 29 a limited vertical mobility can also be provided. It is also possible to pivotably connect the connector 28 to the guide member 30 to provide additional free movement.

Figure 6:
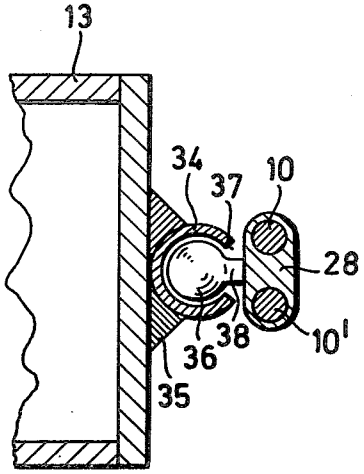
FIG. 6 is a view corresponding to FIG. 5 and depicting a modified form of arrangement and apparatus made in accordance with the invention.

The guidance for the connector 28 can also take the form depicted in FIG. 6 where a part-cylindrical guideway 34 welded to flange plates 35 is affixed to the mounting surface 14 of the support floor structure. A spherical guide member 36 locates in the guideway 34 with limited all-round mobility as well as free displacement in the direction S. The member 36 is connected to the connector 28 with the aid of a cross piece 38 extending through an open slot 37 in the guideway 34. The construction may otherwise be the same as that shown in FIG. 4.

In all the described embodiments of the invention the longitudinal guides, i.e., the bars 10, 10', are guided more or less centrally, and at least intermediate the front and rear end of, the floor structure 13 of the associated support and an especially flexible guidance and support is provided therefore.

It is possible to replace the guide tubes 11 and guide members 12 in the embodiments of FIGS. 1 to 3 with piston and cylinder units with the guide tubes 11 taking the form of cylinders and the guide members 12 taking the form of pistons. This adaptation, which is especially useful in the case of the construction shown in FIGS. 2 and 3 which can be coupled to a hydraulic circuit to perform an additional function, e.g., as shifting rams for advancing the conveyor 19.

I claim:

1. Apparatus for controlling the position of a mineral mining machine guided for movement on guide means, said apparatus comprising at least one beam connected with said guide means, at least one device operable to adjust the angle between the guide means and the beam and further guide means comprising a piston and cylinder unit arranged at a mounting surface of a support which faces an adjacent support of a mine installation, the further guide means serving to pivotably and displaceably connect the end of the beam remote from the first-mentioned guide means to said support and to permit limited angular mobility of the end of the beam to a limited extent wherein the first-mentioned guide means is disposed at one side of a conveyor, and the beam and the adjusting device are connected with bracket means at the opposite side of the conveyor.

2. Apparatus according to claim 1, wherein a plurality of beams, a plurality of adjustment devices and a plurality of further guide means are provided.

3. Apparatus according to claim 1, wherein said at least one beam is resilient.

4. Apparatus according to claim 1, wherein said adjusting device is in the form of a piston and cylinder unit.

5. Apparatus according to claim 1, wherein the bracket means supported on the opposite side of the conveyor is displaceable along the conveyor.

6. Apparatus according to claim 1, wherein the mounting surface is at the side of a floor structure of the support.

7. Apparatus for controlling the position of a mineral mining machine guided for movement on guide means; said apparatus comprising at least one beam connected with said guide means, at least one device operable to adjust the angle between the guide means and the beam and further guide means arranged at an external mounting surface of a support which faces an adjacent support of a mine installation, the further guide means serving to pivotably and displaceably connect the end of the beam remote from the first-mentioned guide means to said support and to permit angular mobility of said end of the beam in all directions to a limited extent, wherein the further guide means comprises a tubular member detachably fixed to said mounting surface which extends parallel to the beam and a spherical guide arranged at the end of the beam and contained in the tubular member.

8. Apparatus according to claim 7, wherein the tubular member is connected with a bracket to the mounting surface which extends parallel to the beam.

9. Apparatus for controlling the position of a mineral mining machine guided for movement on guide means; said apparatus comprising at least one beam connected with said guide means, at least one device operable to adjust the angle between the guide means and the beam and further guide means arranged at a mounting surface of a support which faces an adjacent support of a mine installation, the further guide means serving to pivotably and displaceably connect the end of the beam remote from the first-mentioned guide means to said support and to permit limited angular mobility of the end of the beam to a limited extent wherein the first-mentioned guide means is disposed at one side of a conveyor, and the beam and the adjusting devices are connected with bracket means at the opposite side of the conveyor and wherein two bars are arranged one above the other of said bars are connected in common to the first-mentioned and further guide means to collectively constitute said beam.

10. Apparatus according to claim 9, wherein said further guide means comrpises a guideway detachably secured to said mounting surface and a guide slidable along the guideway and connected via a connector to said bars.

11. Apparatus for controlling the position of a mineral mining machine guided for movement on guide means; said apparatus comprising at least one beam connected with said guide means, at least one device operable to adjust the angle between the guide means and the beam and further guide means arranged at an external mounting surface of a support which faces an adjacent support for a mine installation, the further guide means serving to pivotably and displaceably connect the end of the beam remote from the first-mentioned guide means to said support and to permit angular mobility of said end of the beam in all directions to a limited extent, wherein the further guide means comprises a tubular member detachably fixed to said mounting surface which extends parallel to the beam and a ball piston arranged at the end of the beam and contained in the tubular member.

12. Apparatus for controlling the position of a mineral mining machine guided for movement on guide means; said apparatus comprising at least one beam connected with said guide means, at least one device operable to adjust the angle between the guide means and the beam and further guide means arranged at a mounting surface of a support which surface faces an adjacent support of a mine installation and extends generally parallel to the beam, the further guide means serving to pivotably and displaceably connect the end of the beam remote from the first-mentioned guide means to said support and to permit angular mobility of said end of the beam in all directions to a limited extent, wherein the further guide means comprises a tubular member detachably fixed to said mounting surface and containing a spherical guide arranged at said end of the beam.

13. Apparatus according to claim 12 wherein the tubular member which is detachably fixed to said mounting surface is also adjustable in position.

14. Apparatus according to claim 12, wherein the first-mentioned guide means is disposed at one side of a conveyor and the beam and the adjusting device are connected with bracket means at the opposite side of the conveyor.

15. Apparatus for controlling the position of a mineral mining machine guided for movement on guide means; said apparatus comprising at least one beam connected with said guide means, at least one device operable to adjust the angle between the guide means and the beam and further guide means arranged at a mounting surface of a support which faces an adjacent support of a mine installation, the further guide means serving to pivotably and displaceably connect the end of the beam remote from the first-mentioned guide means to said support and to permit angular mobility of said end of the beam in all directions to a limited extent wherein the further guide means comprises a tubular member containing a ball piston arranged at said end of the beam.

16. Apparatus for controlling the position of a mineral mining machine guided for movement on guide means; said apparatus comprising at least one beam connected with said guide means, at least one device operable to adjust the angle between the guide means and the beam and further guide means arranged at a mounting surface of a support which faces an adjacent support of a mine installation, the further guide means serving to pivotably and displaceably connect the end of the beam remote from the first-mentioned guide means to said support and to permit angular mobility of said end of the beam in all directions to a limited extent wherein two bars are arranged one above the other and said bars are connected in common to the first-mentioned and further guide means to collectively constitute said beam.

* * * * *